United States Patent [19]

Morton

[11] Patent Number: 4,664,317

[45] Date of Patent: May 12, 1987

[54] COMMINUTER APPARATUS

[75] Inventor: Duane C. Morton, Skokie, Ill.

[73] Assignee: Document Security Corporation, Skokie, Ill.

[21] Appl. No.: 704,305

[22] Filed: Feb. 21, 1985

Related U.S. Application Data

[63] Continuation-in-part of Ser. No. 515,346, Jul. 19, 1983, abandoned.

[51] Int. Cl.[4] ..... B02C 18/12; B02C 18/22

[52] U.S. Cl. ..... 241/36; 241/48; 241/60; 241/62; 241/86.1; 241/89.3; 241/100; 241/152 A

[58] Field of Search ..... 241/86.1, 74, 152 R, 241/48, 152 A, 100, 62, 57, 60, 80, 97, 36, 285 R, 285 A, 37, 33, 285 B, 89.3, 89.4

[56] References Cited

U.S. PATENT DOCUMENTS

| | | | |
|---|---|---|---|
| 2,822,846 | 2/1958 | Ward | 241/74 |
| 2,846,152 | 8/1958 | Brophy | 241/74 X |
| 2,960,324 | 11/1960 | Culp | 241/62 X |
| 3,550,527 | 12/1970 | Sinitsin et al. | 241/48 X |
| 4,261,523 | 4/1981 | LaPointe | 241/285 A X |
| 4,487,371 | 12/1984 | Day | 241/48 |

*Primary Examiner*—Mark Rosenbaum
*Attorney, Agent, or Firm*—Welsh & Katz, Ltd.

[57] ABSTRACT

A comminuter apparatus for comminuting documents and the like in a manner to prevent their legible reconstruction includes a feed hopper having a closable access opening and a discharge opening such that materials introduced into the hopper pass by gravity to a cutter assembly having driven rough-cut and primary cutter blade groups cooperative with an annular perforated comminuter plate to comminute the material and pass it to a discharge chamber from which it is transferred to a collection receptacle or waste compactor. Numerous features are provided to prevent clogging and insure safe operation.

23 Claims, 11 Drawing Figures

COMMINUTER APPARATUS

BACKGROUND OF THE INVENTION

This is a continuation-in-part application from Ser. No. 515,346, filed July 19, 1983, now abandoned.

The present invention relates generally to comminuting apparatus, and more particularly to a novel comminuter apparatus which finds particular application in destroying documents by comminution such that the documents cannot be reconstructed in a legible form.

Apparatus or machines for shredding or otherwise destroying materials, such as confidential documents, drawings, financial statements and money transfer instruments and records, and other documents which have relatively confidential and/or high security information thereon, are generally known. Such apparatus find particular application in many governmental agencies and private business concerns where it is desirable for security and confidentiality purposes to regularly destroy the contents of waste baskets, archived or current files and publications, blueprints, etc., both bound and unbound, so that they cannot be reconstructed or their contents otherwise deciphered after undergoing passage through the document destroying apparatus. It will be appreciated that the higher the degree of classification or confidentiality in the material, the more important it is that the documents be thoroughly comminuted so as to preclude their reconstruction to a legible document.

The known comminuter apparatus exhibit a number of drawbacks and disadvantages which limit their usage with high-security documents and the like. A major drawback found in most known comminuter or document disintegrating apparatus is that while they are capable of shredding the material so as to make it a tedious task to reconstruct the documents in a legible manner, they do not preclude the reconstruction process altogether. This has proven to be a major drawback where the documents are highly sensitive and disclose matters involving, for example, national security.

Another significant drawback in the known document destroying or comminuter apparatus is that they generally require sequential handfeeding of individual documents or relatively small quantities thereof into the apparatus, thereby making such apparatus relatively slow and cumbersome where substantial quantities of documents, such as large volumes of cancelled checks and/or other financial records as generally retained by banking institutions, must be destroyed, or where smaller volumes of high security documents must be totally destroyed very quickly.

A further drawback in the known document destroying apparatus is that while they may be sturdy enough to withstand continued operation when paper-type objects or documents are inserted for comminution, they are incapable of receiving and comminuting objects other than paper-type products without adversely affecting the apparatus.

SUMMARY OF THE INVENTION

One of the primary objects of the present invention is to provide a novel comminuter apparatus which is of sturdy construction and is capable of substantially improved comminution or disintegration of document materials and the like in a manner to prevent their legible reconstruction.

Another object of the present invention is to provide a novel comminuter apparatus which is highly efficient in destroying or reducing documents to a form preventing legible reconstruction and identification thereof and which is capable of receiving relatively large quantities of materials without need for continued interruption to facilitate sequential feeding of documents into the apparatus.

A feature of the comminuter apparatus in accordance with the invention lies in the provision of a feed hopper adapted to receive materials to be comminuted in relatively large bulk quantity or continually fed thereto in smaller quantities, and which causes the material to be directed by gravity to a cutter blade assembly operative to comminute the material to minute particle size preventing legible reconstruction of any document materials whereafter the comminuted particles are automatically transferred to a waste collection bin.

Another feature of the comminuter apparatus in accordance with the invention lies in the provision of means to effect air flow into the feed hopper to induce passage of materials to a cutter assembly chamber for comminution, and including by-pass means selectively operable to pass air into the cutter chamber in a manner to prevent clogging and maintain optimum efficiency during comminution.

Another feature of the comminuter apparatus in accordance with the present invention lies in the provision of a novel cutter assembly located at the gravity feed end of a feed hopper and having a preliminary blade group operative to effect generally rough-cut chopping of materials impacted by the preliminary blade group while substantially preventing bridging of material across the cutter assembly, the cutter assembly also having a primary cutter blade group disposed below the preliminary blade group and cooperative with an annular perforated comminuter plate to comminute the material into minute particle form preventing reconstruction of the comminuted documents in a legible form.

Still another feature of the comminuter apparatus in accordance with one embodiment of the invention lies in the provision of means operative to recirculate material from the waste collection bin back into the feed hopper for recirculation through the cutter assembly.

Another feature of one embodiment of the comminuter apparatus in accordance with the invention lies in the provision of compacter means operative to receive the comminuted material and effect substantially reduced volume compacting thereof whereby to facilitate substantially improved volume capability.

Further objects and advantages of the invention, together with the organization and manner of operation thereof, will become apparent from the following detailed description of the invention when taken in conjunction with the accompanying drawings wherein like reference numerals designate like elements throughout the several views.

DESCRIPTION OF PREFERRED EMBODIMENTS

Figure 1:
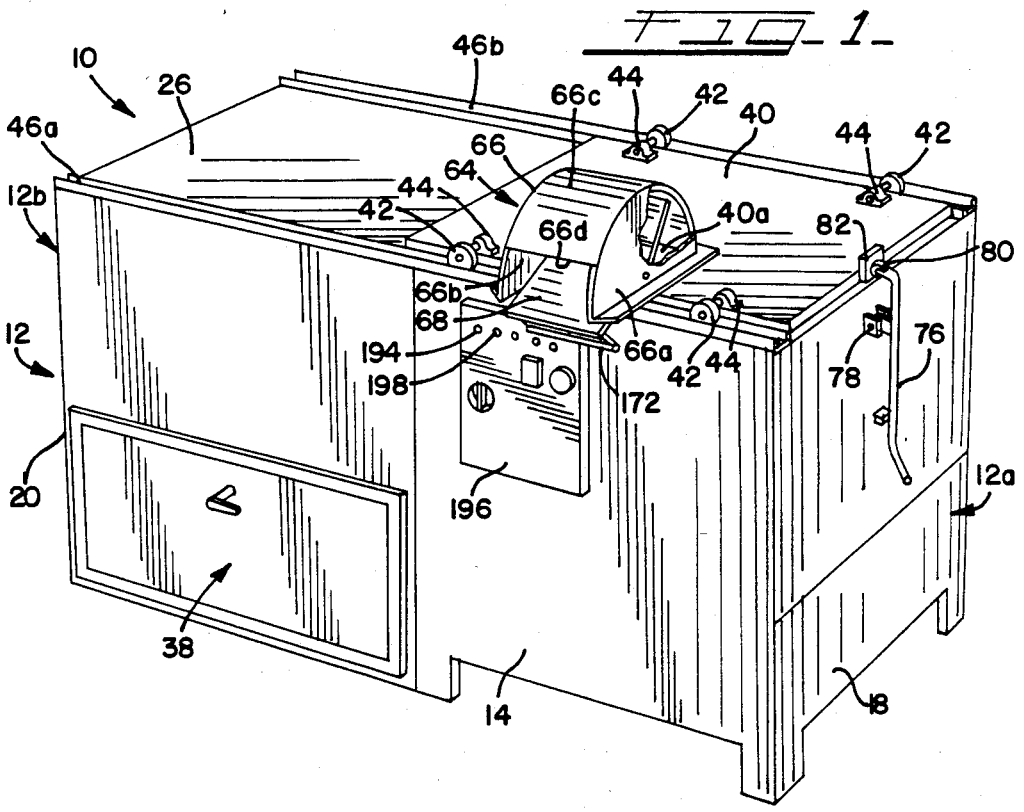
FIG. 1 is a perspective view of a comminuter apparatus constructed in accordance with the present invention.

Referring now to the drawings, and in particular to FIGS. 1-3 and 5, a comminuter apparatus constructed in accordance with the present invention and which finds particular application in comminuting or destroying documents or writings in a manner to prevent their reconstruction as legible documents is indicated generally at 10. The comminuter apparatus 10, which may alternatively be termed a document destruction apparatus, is particularly adapted for comminuting high-security or highly sensitive documents so as to prevent their reconstruction as is possible with shredder-type machines which cut the documents into ribbon-like fragments. Although requiring meticulous and time consuming effort, the ribbon fragments can be reconstructed into legible form.

The comminuter apparatus 10 includes a generally rectangular housing, indicated generally at 12, which includes upstanding front and rear walls 14 and 16, respectively, and upstanding end walls 18 and 20, all of which have generally coplanar upper marginal edges. The walls 14, 16, 18, and 20 may be termed side walls and preferably comprise suitable strength metallic sheets or plates which are secured to an internal framework or chassis constructed from suitable angle-iron or the like, a portion of the internal framework being illustrated in FIG. 2 at 24.

In the illustrated embodiment, substantially one-half of the rectangular housing 12, such as the right-hand end portion indicated at 12*a*, defines a feed hopper and comminuting end of the apparatus. The opposite end 12*b* of the housing defines a waste collection end and, in one embodiment, also includes means facilitating selective return of comminuted material back into the comminuter end 12*a*. As will be described, another embodiment of the comminuter apparatus employs a compacter at the waste collection end of the apparatus.

Figure 2:
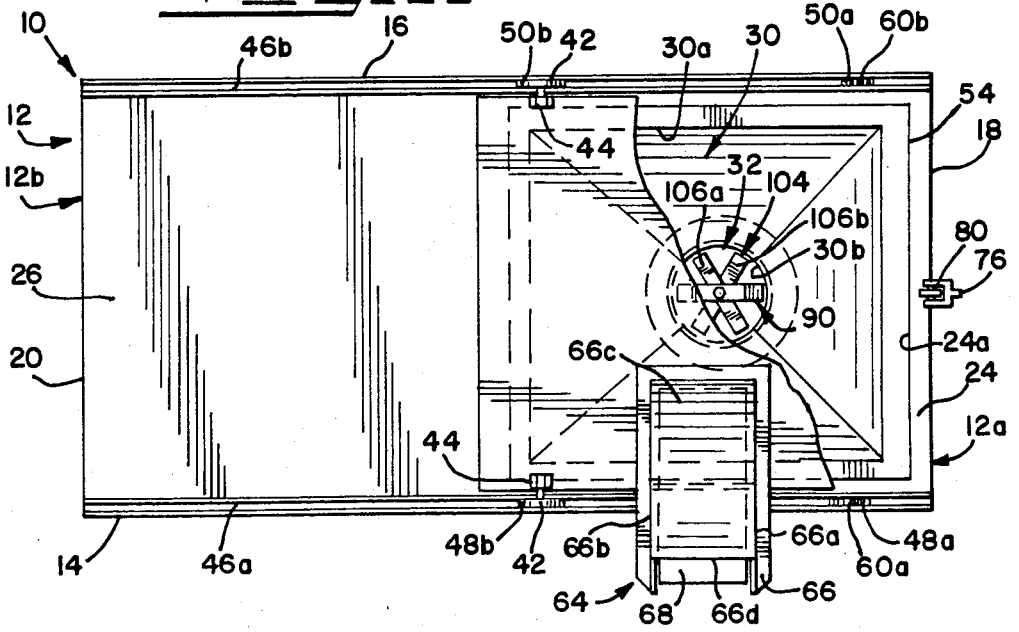
FIG. 2 is a plan view of the comminuter apparatus of FIG. 1 with portions broken away for purposes of clarity.

As illustrated in FIG. 2, the upper internal framework 24 defines a generally rectangular opening 24*a* having an open area equal to approximately one-half the upper horizontal area defined by the upper marginal edges of the upstanding walls 14, 16, 18 and 20. A generally planar upper wall or plate 26 is affixed to and supported by the internal framework so as to overlie or close the upper left-hand end 12*b* of the housing with its peripheral edges abutting the adjacent upper marginal edge portions of the side walls in sealed relation therewith.

Figure 3:
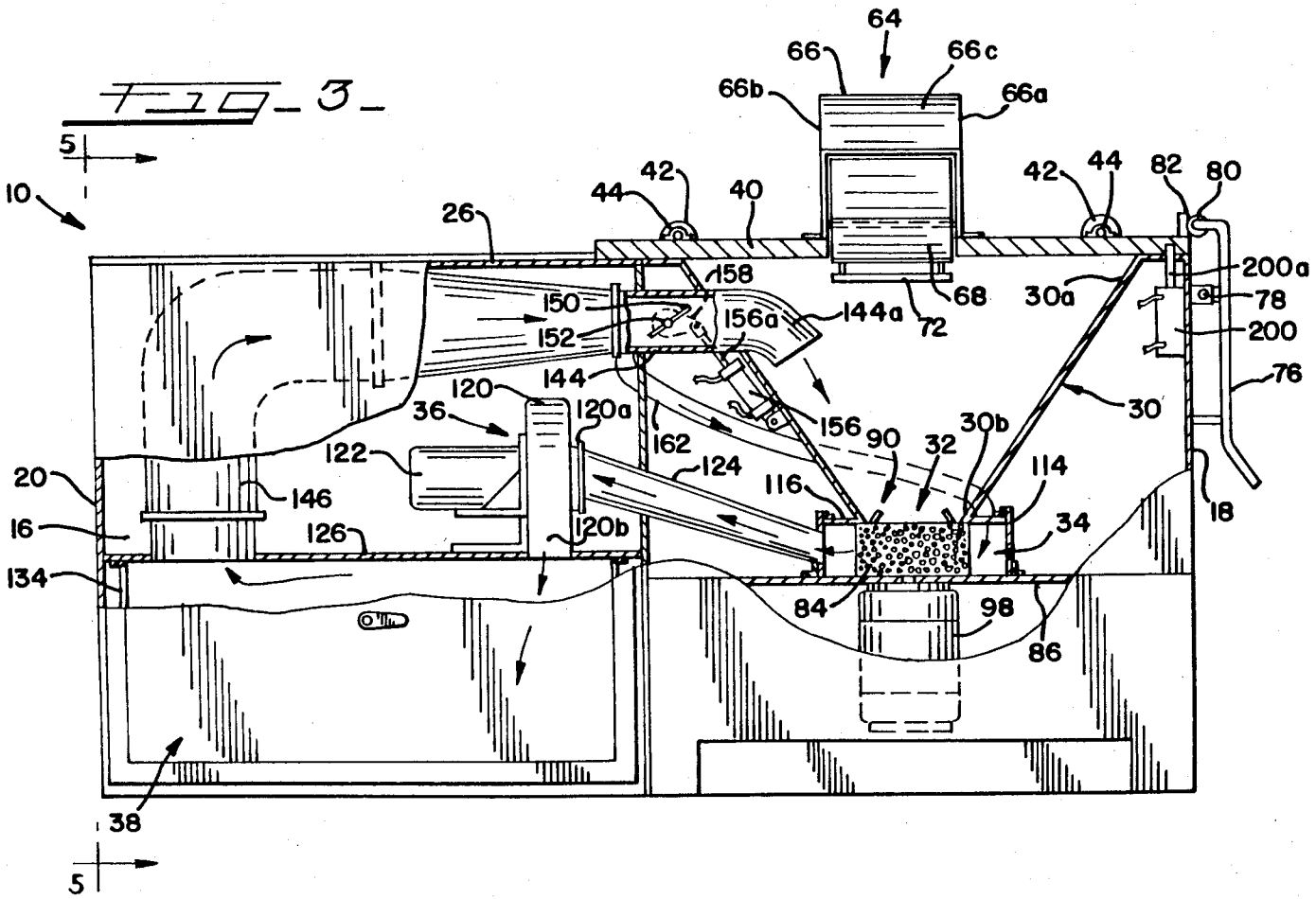
FIG. 3 is a front elevational view of the comminuter apparatus of FIG. 1 with portions broken away to better illustrate internal components of the apparatus.
Figure 5:
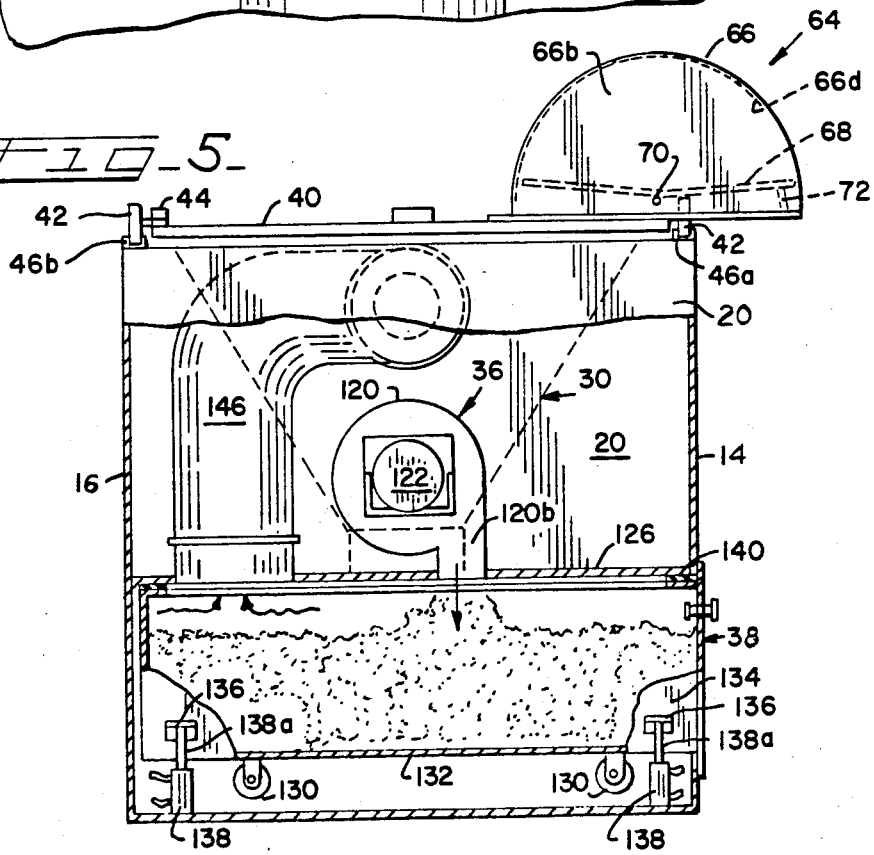
FIG. 5 is an end view taken substantially along line 5—5 of FIG. 3 but with portions broken away for purposes of illustration.

The right-hand end 12*a* of housing 12 houses a generally frusto-conical feed hopper, indicated generally at 30 in FIGS. 2, 3 and 5, which defines an internal chamber having an upper rectangular access opening 30*a* and a lower circular discharge end 30*b*. The hopper 30 provides means for receiving and guiding or feeding materials to be comminuted to a cutter assembly, indicated generally at 32, operative to comminute the materials whereafter the comminuted materials or particles are first passed into an annular discharge chamber, indicated generally at 34. The comminuted particles are then transferred to the waste collection end 12*b* of housing 12 by means of an impeller-type feed or transfer mechanism, indicated generally at 36 in FIGS. 3 and 5. In the embodiment of FIG. 1, the transfer means 36 is operative to transfer the comminuted or particulate material from the discharge chamber 34 to a drawer type waste receptacle or collection bin as indicated generally at 38.

A rectangular generally planar metallic cover member or lid 40 is supported by the housing 12 so as to enable selective movement between a first closed position overlying the rectangular opening 24*a* and thereby the upper access opening of the hopper 30 and a second open position exposing the access opening of hopper 30 to facilitate introduction of selective quantities of material into the hopper preparatory to a comminuting operation. To this end, the cover member 40 has two laterally opposite pairs of roller wheels 42 mounted adjacent its longitudinal edge surfaces through corresponding brackets 44 affixed to the upper surface of the cover plate. The roller wheels 42 are positioned so as to ride in laterally opposite longitudinally extending generally U-shaped channels or tracks 46*a* and 46*b* which are affixed to the upper forward and rear frame members of the housing framework adjacent opposite sides of the hopper access opening 30*a*, as illustrated in FIGS. 1 and 2. The channels or tracks 46*a* and 46*b* facilitate horizontal movement of the cover member 40 between its open and closed positions relative to the hopper 30.

Figure 6:
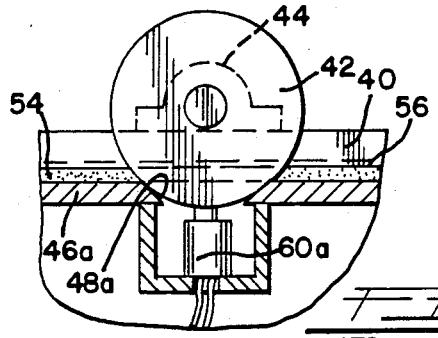
FIG. 6 is a fragmentary sectional view illustrating a control limit switch in cooperation with a roller wheel of the hopper closure cover when in its closed position.
Figure 7:
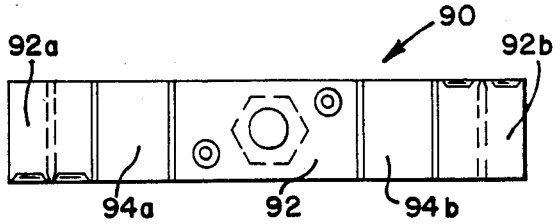
FIG. 7 is a plan view, on an enlarged scale, of the upper blade on the cutter blade illustrated in FIG. 4, taken substantially along line 7—7 of FIG. 4.

With particular reference to FIG. 6, taken in conjunction with FIG. 2, each of the tracks 46*a* and 46*b* has a pair of recesses or depressions 48*a*, *b* and 50*a*, *b*, respectively, which are spaced apart such that each recess receives a corresponding roller 42 therein when the cover plate 40 is in its closed position over the opening 24*a* and the upper access opening to the hopper 30. The recesses 48*a*, *b* and 50*a*, *b* are such that when the cover member 40 is moved to its forward closed position, the roller wheels are disposed within the corresponding recesses and cause lowering of the cover member such that an endless peripheral seal 54 circumferentially of the hopper access opening 30*a* seals with the cover member peripherally of the hopper. Preferably, a sheet of high-strength woven metallic mesh-like material is affixed to the lower surface of the cover member 40 such as indicated at 56 in FIG. 6. The woven mesh serves as a high-strength barrier preventing piercing of the cover member should a metallic object or the like be thrown upwardly against the cover member by the cutter assembly 32.

With the cover member 40 in its open position, relatively large quantities of materials to be comminuted may be placed into the hopper 30 preparatory to comminuting the materials. After loading, the cover member is moved to a closed position during a comminuting operation. To ensure that the cover member is in its closed position during initiation of a comminuting cycle, sensor means in the form of a pair of electromechanical sensor switches 60*a* and 60*b* are mounted to underlie the forward recesses 48*a* and 50*a* in the guide tracks 46*a, b,* respectively, such as illustrated at 60*a* in FIG. 6, so as to detect the presence of the corresponding guide rollers 42 when the cover member is in its closed position. The sensors 60*a, b* are connected in a control circuit so as to prevent energizing of a cutter assembly drive motor in the event the cover member is not in its closed position.

In the illustrated embodiment, means in the form of a feeder chute, indicated generally at 64, is carried by the cover member 40 and is operative to facilitate manual feeding of documents or small quantities of documents into the hopper 30 while the cover member 40 is in its closed position with the cutter assembly 32 energized. The feeder chute 64 includes a housing 66 having generally semicircular parallel side walls 66*a, b* and an arcuate upper wall 66*c* which extends from the cover member 40 to a forward terminal edge 66*d*. The housing 66 is affixed to the upper surface of the cover member 40 so as to overlie a generally rectangular opening 40*a* in the cover member. A loader and closure plate 68 is pivotally mounted within the housing 66 through a transverse pivot shaft 70 and has an outer peripheral surface adapted for sealing relation with the internal surfaces of the upstanding sidewalls and arcuate top of the housing 66. The loader plate 68 is formed so as to be movable to a forward or downward loading position, as illustrated in FIG. 1, wherein materials to be comminuted may be inserted or positioned onto the forward end of the loader plate. Thereafter, the loader plate may be pivoted upwardly to cause the rearward end of the loader plate to enter the opening 40*a* in the cover plate and deposit the materials into the hopper 30, the loader plate being continually sealed with the housing 66 so as to prevent the egress of comminuted particles or any dust created within the hopper chamber. A handle 72 is affixed to the loader plate 68 to facilitate manual movement of the loader plate as aforementioned.

To facilitate opening of the cover plate 40 from its closed position as illustrated in FIG. 1, a pusher lever 76 is pivotally mounted at 78 on the end of wall 18 of housing 12. The pusher lever 76 carries a roller 80 on its upper end which is adapted to engage a pusher plate 82 affixed to the right-hand edge of the cover plate 40 such that outward pivotal movement of the lower end of the pusher lever initiates movement of the cover member toward its open position.

As illustrated in FIGS. 2, 3 and 5, the hopper 30 has a generally conical-shape configuration and extends from its upper generally rectangular access opening 30*a* to its lower circular discharge opening 30*b* which communicates with a cutter chamber in which the cutter assembly 32 is located. In the transition from the upper rectangular access opening to the lower circular discharge opening of the hopper 30, the conical-shaped configuration of the hopper is defined in part by substantially planar wall surfaces so as to establish a frustoconical hopper having a non-circular transverse cross section throughout a substantial portion of its height. The hopper 30 is preferably made of a suitable metallic sheet material and, is desired, may have one or more vanes or fingers (not shown) affixed to the inner surface of the conical hopper wall and extending inwardly therefrom in normal relation thereto. Such vanes and/or fingers serve to prevent materials introduced into the hopper from undergoing a continuous swirling action and thereby cause the documents to be fed to the cutter assembly 32. The non-circular transverse configuration of the hopper also serves to minimize circular swirling of materials introduced into the hopper and thereby induces movement of the materials to the cutter assembly.

Figure 4:
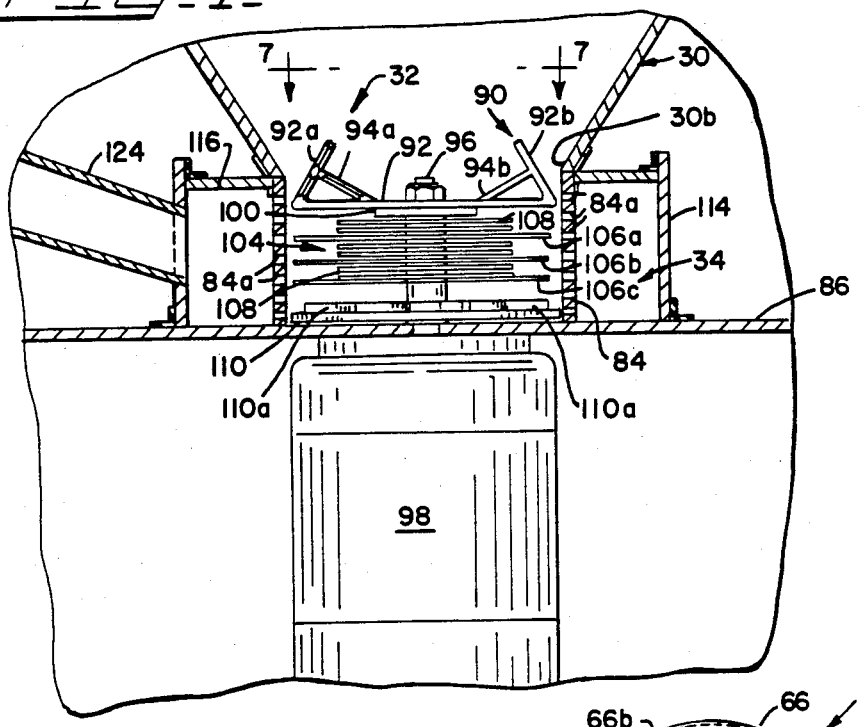
FIG. 4 is an enlarged vertical sectional view of one embodiment of a cutter assembly disposed at the discharge end of the material feed hopper.

Referring to FIG. 4, the lower end of the hopper 30 which defines the circular discharge opening 30*b* is secured, as by welding, to an upper annular edge of an annular perforated comminuter plate 84 which is supported on a horizontal support plate 86 mounted internally of the right-hand end 12*a* of housing 12. The comminuter plate 84 is made of a suitable metallic material and has a uniform array of relatively closely spaced openings or apertures 84*a* formed therein about its full peripheral surface, the apertures being selectively sized to provide the desired particle size for the comminuted material. For example, the apertures 84*a* in the comminuter plate may be sized between 3/16 and ½ inch diameter, while the thickness of the comminuter plate may be varied between 3/16 and ¾ inch. Both the aperture diameter and comminuter plate thickness depend upon the particle size of comminuted material desired and the composition or makeup of the material being comminuted. The annular comminuter plate 84 defines a cutter chamber internally thereof.

In the embodiment illustrated in FIG. 4, the cutter assembly 32 includes a rough-cut blade, indicated generally at 90, having a generally horizontal blade body 92 and integral angularly upwardly extending wings or arms 92*a* and 92*b*. Inclined struts 94*a* and 94*b* are integrally connected between the horizontal blade body 92 and the arms 92*a* and 92*b*, respectively. The rough-cut blade 90, which may alternatively be termed a preliminary or rough-cut blade group, is mounted on a drive shaft 96 of an electric drive motor 98 for rotation therewith. The drive motor 98 is mounted to the lower surface of the support plate 86 such that the motor drive shaft extends generally vertically upwardly through a suitable opening in the support plate coaxially with the center axis of the annular comminuter plate 84. In one embodiment, the motor drive shaft 96 has a hexagonal outer configuration on which a drive plate 100 is mounted for relation therewith, the rough-cut blade 90 being suitably affixed to the drive plate 100 in driven relation. Preferably, the leading edges of the upwardly inclined blade arms 92*a*, 92*b* and the associated struts 94*a*, 94*b* have cutting edges formed thereon which serve to effect rough-cutting of any materials impacting the blade 90 during a comminuting operation. The rough-cut blade 90 is supported within the cutter chamber such that the upper ends of the cutter arms 92*a, b* extend upwardly within the lower end of the feed hopper as illustrated in FIG. 4. In this manner, the blade 90 serves to substantially reduce bridging on materials across the discharge opening 30*b* of the feed hopper.

The cutter assembly 32 also includes a primary cutter blade group, indicated generally at 104, which is mounted on the motor drive shaft 96 for driven relation therewith below the rough-cut blade 90 such that material fragments created by the rough-cut blade 90 pass downwardly by gravity into the primary cutter blade group 104. In the embodiment of FIG. 4, the primary blade group 104 includes three cutter blades 106*a, b* and *c* which have central hexagonal apertures to facilitate driven relation with the hexagonal motor drive shaft 96 and which are spaced axially apart by suitable spacers 108 interposed between the blades 106*a–c*. The blades 106i a–c are mounted on the motor drive shaft 96 so as to create six equidistantly circumferentially spaced cutter blade arms about the axis of the motor drive shaft, as shown in FIG. 2, and have their outer terminal edges positioned in closely spaced relation from the inner surface of the annular comminuter plate 84. The forward leading edges of the blades 106*a–c* have sharpened cutting edges formed thereon.

The primary blade group 104 illustrated in FIG. 4 also includes a circular impeller plate 110 which is mounted on the motor drive shaft 96 to underlie the cutter blades 106*a–c* while being rotatable with the motor drive shaft. The impeller plate 110 has a plurality of radially extending upwardly projecting ribs or fins 110*a* formed thereon which serve as slingers for any comminuted materials which pass downwardly to the impeller plate 110 during comminuting. During a comminuting operation, the rough-cut materials passing downwardly by gravity from the rough-cut blade 90 are further comminuted by the cutting blades 106*a–c* and are simultaneously thrown outwardly through the apertures 84*a* in the comminuter plate 84 to further disintegrate or comminute the materials into smaller particle size as established by selection of the aperture size in the comminuter plate. Any particles passing downwarddly to the impeller plate 110 are slung radially outwardly through the lower apertures in the comminuter plate to effect further comminuting thereof. It is believed that maintaining a relatively sharp corner edge at the intersection of each aperature 84*a* with the inner surface of the comminuter plate provides a shearing and cutting action to further comminute material particles forced through the comminuter plate.

With continued reference to FIG. 4, comminuted particles passing outwardly through the apertures in the comminuter plate 84 pass into the annular discharge chamber 34 which is defined between the outer surface of the annular comminuter plate and an annular wall 114 mounted on the support plate 86 in concentric relation with the comminuter plate. An annular plate 116 is affixed to and between the upper ends of the comminuter plate 84 and annular wall 114 to establish the upper boundary of the discharge chamber.

As aforementioned in respect to the embodiment of the comminuter apparatus 10 illustrated in FIGS. 1–5, comminuted material is transferred from the discharge chamber 34 to the drawer-type receptacle or collection bin 38 by means of the impeller-type transfer means 36. The transfer means 36, which may also be termed a blower assembly, includes a conventional impeller-type pump or blower having a radial blade impeller (not shown) rotatably supported within a housing 120 and being rotatably driven by a suitable electric drive motor 122. A tubular flow conduit or duct 124 is connected at one end to the annular wall 114 so as to communicate with the discharge chamber 34, and is connected at its opposite end to an annular mounting flange 122*a* on the housing 120 in communication with the center of the impeller within housing 120. The impeller housing 120 and drive motor 122 are supported on a horizontal support plate 126 which is affixed within the end 12*b* of housing 12 so as to define a waste collection chamber below plate 126. The impeller housing 120 has a discharge nozzle 120*b* which extends through a suitable opening in the horizontal support plate 126.

In the embodiment illustrated in FIGS. 3 and 5, the discharge nozzle 120*b* of the impeller transfer means 36 is adapted to discharge comminuted particles into the receptacle or collection drawer 34. To this end, the collection drawer 34 is of generally rectangular configuration and has laterally opposite pairs of guide wheels or rollers 130 mounted on a bottom wall 132 of the drawer to facilitate rolling insertion and withdrawal of the drawer through a suitable rectangular opening in the lower left-hand end of the housing front wall 14. The upstanding sidewalls of the drawer 34, one of which is indicated at 134 in FIG. 5, have suitable outwardly extending L-shaped lift brackets 136 affixed thereon each of which is adapted to overlie a corresponding upwardly extendable piston 138*a* of a hydraulic or pneumatic cylinder or ram 138 when the drawer is fully inserted into the housing 12. When in its inserted position, actuation of the cylinders or rams 138 serves to lift the drawer upwardly such that a peripheral seal 140 on the upper peripheral edge of the drawer abuts the lower surface of the support plate 126 in sealed relation therewith.

It will be appreciated that the impeller-type feed means 36 operates to effect a suction action within the discharge chamber 34 which acts through the perforated commutator plate 84 to create a reduced pressure within the hopper 30 when the cover member 40 is in closed sealed relation over the upper access opening 30*a* of the hopper. This suction or reduced pressure within the hopper is utilized to induce air flow into the hopper in a manner to urge material in the hopper toward the cutter assembly 32 and effect transfer of comminuted material into the discharge chamber 34. To this end, a tubular air input duct 144 is supported such that a downwardly curved discharge end 144*a* extends through a suitable opening in the hopper 30 generally adjacent the upper end thereof. In the embodiment illustrated in FIGS. 3 and 5, a return duct 146 is interconnected between the outer end of the air input duct 144 and the support plate 126 such that duct 146 communicates with a suitable opening in the support plate 126 and thereby facilitates airflow from the collection bin or drawer 134 to the air input duct 144. In this manner, air flow induced within the ducts 146 and 144 by the impeller pump 136 may be utilized to draw comminuted material from the waste collection drawer 34 and return the comminuted material for a second or further pass through the cutter assembly 32 whereby to further comminute the material into smaller particle size.

To facilitate selective airflow through the ducts 146 and 144, and thus control airflow and particle flow into the hopper 30, valve means in the form of a baffle-type air valve is cooperative with the duct 144 to enable selective opening and closing of the flow passage therein. As illustrated in FIG. 3, the baffle-type valve includes a generally circular baffle plate 150 which is fixed on a transverse pivot pin 152 and has a circular diameter substantially equal to the adjacent inner diameter of the duct 144. In this manner, pivotal movement of the pivot pin 152 and baffle plate 150 serves to control airflow through the discharge end 144*a* of duct 144, and thus also controls the return of particulate material from the collection drawer 34 to the cutter assembly.

In an alternative embodiment, the return duct 146 is eliminated so that the outer end of the air duct 144 opens within the end 12*b* of housing 12. Through movement of the air baffle valve 150, air may be drawn into the hopper 30 to selectively induce material flow toward the cutter assembly 32. Control means in the form of a double acting pneumatic or hydraulic cylinder 156 (FIG. 3) is mounted on the outer wall of the hopper 30 and has an extendable piston 156*a* eccentrically connected to the pivot pin 152, as through a lever arm 158. Extension and retraction of the piston 156*a* effects predetermined movement of the baffle valve plate 150.

In accordance with one feature of the comminuter apparatus 10, a tubular by-pass duct or conduit 162 has one end secured to the airflow duct 144 in communication therewith outwardly from the valve baffle plate 150, and has its opposite end connected to the annular plate 116 so as to communicate with the discharge chamber through a suitable opening in plate 116. In this manner, closing the baffle valve plate 150 substantially stops air flow through duct 144*a* into the hopper 30 and causes air to be drawn through duct 162 into the discharge chamber 34 so as to create a turbulent air action within the discharge chamber. This action creates an air flushing which prevents the buildup of fines within the discharge chamber and insures passage of comminuted material through the comminuter plate 84 and from the discharge chamber through the duct 124 to the collection drawer 34. In furtherance of this feature, the double acting cylinder or ram 156 is connected in a control circuit which includes conventional means (not shown) to detect the current load drawn by the cutter blade drive motor 98 such that detection of an increased cutter motor load effects movement of the baffle plate valve 150 to a position substantially closing duct 144 and thereby causing airflow through duct 162 into the discharge chamber to clear any blockage or clogging in the cutter chamber so as to reduce the cutter motor load and maintain it at a generally uniform load level. Stated alternatively, the control circuit is operative to effect bypass of air through the bypass duct 162 into the cutter chamber 34 in response to a predetermined increase in resistance to rotation of the rough-cut and primary cutter blades of the cutter assembly which directly affect the load on the cutter drive motor 98.

Figure 8:
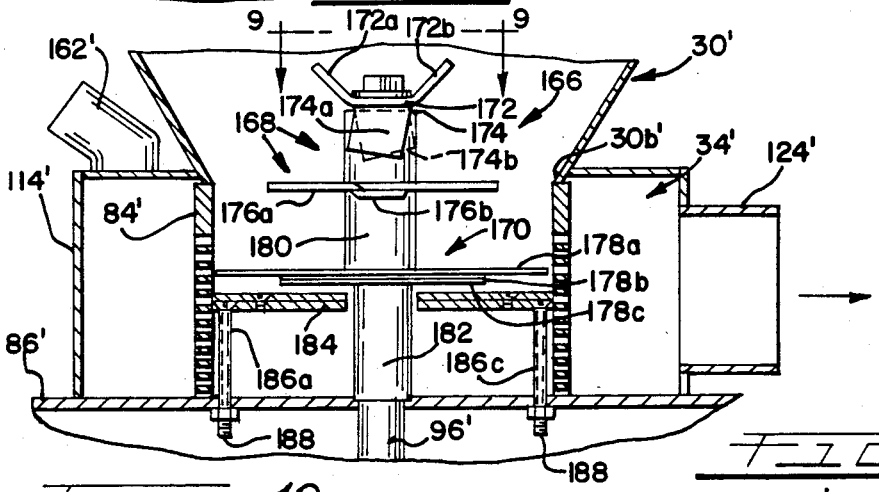
FIG. 8 is a vertical sectional view similar to FIG. 4 but illustrating an alternative embodiment of a cutter blade assembly for use in the comminuter apparatus of FIG. 1.
Figure 9:
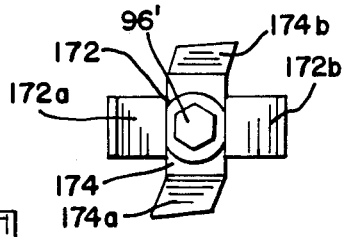
FIG. 9 is a plan view of the upper blade assembly of FIG. 8, taken substantially along line 9—9 of FIG. 8 and looking in the direction of the arrows.

FIGS. 8 and 9 illustrate an alternative embodiment of a cutter assembly, indicated generally at 166, which may be utilized in conjunction with the comminuter apparatus 10. The cutter assembly 166 is supported internally of an annular comminuter plate 84' which is substantially identical to aforedescribed comminuter plate 84 and is supported on a horizontal support plate 86' adapted to be affixed within the comminuter end of the housing 12 in similar fashion to the aforedescribed support plate 86. The annular comminuter plate 84' has its upper marginal edge secured to or otherwise abutting the lower marginal edge of a feed hopper 30' and is concentrically surrounded by an annular generally cylindrical wall 114' and a generally planar annular wall 116' so as to establish a discharge chamber 34' at the lower end of the hopper 30' in similar fashion to the aforedescribed discharge chamber 34.

The cutter assembly 166 includes an upper rough-cut or preliminary cutter blade group 168 and a primary cutter blade group 170 disposed below the upper rough-cut blade group. The upper rough-cut blade group includes an upper impact or chopper blade 172 which as upwardly inclined impact arms 172*a* and 172*b* and is affixed on the upper end of a drive motor shaft 96' for driven rotation therewith. Motor shaft 96' comprises the driven shaft of an electric drive motor (not shown) similar to the aforedescribed drive motor 98. The upwardly inclined arms 172*a, b* of the impact blade 170 have blunt edges such that when engaged by material advancing downwardly within the upper 30', they serve to knock the material off center so as to prevent bridging of the discharge end 30'*b* of the hopper.

The upper rough-cut blade group includes a second impact or chopper blade 174 mounted immediately below the impact blade 172 and having downwardly inclined arms 174*a* and 174*b* which, in addition to being downwardly inclined, also have their longitudinal center lines inclined at a pitch angle of approximately 10°–15° relative to a plane normal to the plane of FIG. 9 and containing the center line of the drive shaft 96' and the longitudinal center line of the horizontal or noninclined portion of blade 174.

The downwardly inclined ends 174*a* and 174*b* of the impact blade 174 are pitched so that any material engaged by the inward or lower surfaces of the downwardly inclined arms is pushed downwardly, while material engaged by the upwardly facing surfaces of the arms 174*a, b* is pushed upwardly into the hopper chamber whereafter it may again work its way down to the cutter assembly.

The rough-cut blade group 168 includes a lower set of cutter blades 176*a* and 176*b* which are disposed at 90° to each other and are fixed on the motor drive shaft 96' so as to be rotatably driven thereby. The cutter blades 176*a* and 176*b* establish four equidistantly circumferencially spaced radial cutter blades extending outwardly from the axis of the motor shaft 96' and have cutting edges formed on their leading edge surfaces so as to effect cutting of materials passing downwardly in contact therewith from the impact blades 172 and 174. It is noted that the rough-cut or impact blades 172 and 174 are positioned within the lower end of the hopper 30', while the cutter blades 176*a* and 176*b* are positioned substantially at or within the discharge opening 30'*b* of the hopper.

The lower primary cutter blades 170 comprise three generally planer rectangular shaped blades 178*a*, 178*b* and 178*c* which are mounted on the motor drive shaft 96' for rotation therewith. The blades 178*a–c* are angularly spaced about the drive shaft 96' so as to establish six equidistantly circumferencially spaced radial blades and having their outer terminal ends in closely spaced relation to the inner surface of the annular comminuter plate 84'. The blades 178*a, b* and *c* may be mounted in spaced relation below the blades 176*a, b* through a suitable spacer sleeve 180 and are similarily positioned upwardly from the support plate 86' through a spacer sleeve 182. An annular plate member 184 is supported in predetermined relation beneath the cutter blades 178*a–c* by a plurality of tubular spacers, two of which are indicated at 186*a* and 186*b* in FIG. 8, through which extend suitable mounting bolts 188.

The cutter assembly 166 works in similar fashion to the aforedescribed cutter assembly 32 in that materials passing downwardly within the hopper 30' are impacted by the rough-cut blades or impact 172, 174 and 176*a, b* so as to initiate cutting or severing of the materials into smaller size pieces which progress downwardly to be engaged by the cutter blades 178*a–c* which comminute the material pieces into much smaller size particles and pass them through the comminuter plate 84' which further comminutes the particles and effects discharge into the discharge chamber 34' from which they are drawn through a vacuum tube or duct 124' to a collection bin or other waste collector.

As aforementioned, the position sensor switches 60*a* and 60*b* which sense the closed position of the hopper cover member 40, the cutter blade drive motor 98 and the double acting cylinder 156 are connected in a primary control circuit the main power to which is controlled by means of a suitable primary power switch 194 mounted on a control panel 196 on the front wall 14 of housing 12. The main control circuit also control actuation of a pneumatic double acting cylinder 200 which is mounted on the inner surface of the end wall 18 and has an extendable piston 200*a* adapted to engage a locking recess in the hopper cover member when in its closed position. A suitable time delay relay is connected in circuit between the position sensor switches 60 *a, b* and the cutter blade drive motor 98 so as to effect a predetermined time delay between closing of the hopper cover member 40 and energizing of the drive motor 98 after actuating a "start" switch 198 on the control panel. This further insures that the cover member is closed when the cutter assembly 32 is operated. The impeller pump or blower assembly 36 is also connected in the control circuit so as to be energized and initiate a suction action within the discharge chamber 34 when the hopper closure member 40 is in closed position and the start switch 198 is turned on.

The primary control circuit also includes time delay means interposed between the hopper cover locking cylinder 200 and the cutter blade drive motor 98 so as to effect a predetermined time delay before retraction of the locking piston 200*a* after de-energizing the cutter blade drive motor. Such time delay prevents opening of the hopper cover member 40 before the cutter blade drive motor so as to insure that the cutter blades have stopped rotation.

Figure 10:
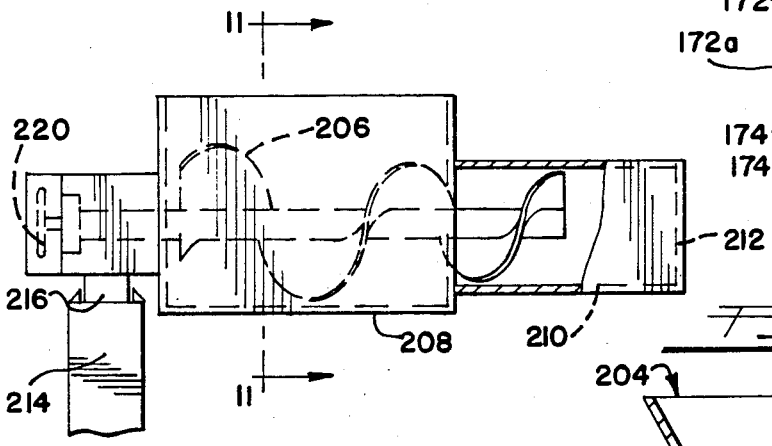
FIG. 10 is a perspective view illustrating a compacter to receive and compact comminuted material.
Figure 11:
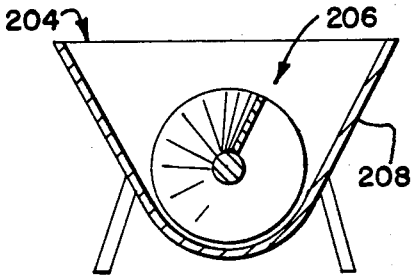
FIG. 11 is a transverse sectional view taken along line 11—11 of FIG. 10.

As aforementioned, if desired, a compactor may be mounted within the waste collection end 12*b* of the comminuter housing 12 to receive comminuted material from the discharge chamber 34 and effect compacting thereof so as to substantially reduce the volume and thus prolong operation of the comminuting apparatus as compared with necessary shutdowns to empty the waste collection drawer 34. FIGS. 10 and 11 illustrate a compactor apparatus, indicated generally at 204, adapted to be mounted within the collection end 12*b* of the housing 12 to receive comminuted material and compact it to a volume reduction of approximately 24 to 1. The compactor 204 is of the auger-type and includes a spiral blade auger rotatably supported within a housing having a material receiving chamber 208 open at its upper end to receive particulate material. The compactor housing also has a cylindrical tubular end 210 mounted coaxially over a discharge end of the auger 206 so that material fed by the auger from the receiving housing 208 is passed into the housing 210 and compressed against a removable end plate 212. A drive motor 214 and associated speed reducer 216 are connected through a drive chain 220 to the end of the auger 206 opposite the compactor housing 212 so as to effect selective rotation of the auger in a direction to move comminuted material into the closed housing 210 and effecting compacting thereof.

In replacing the collection drawer 34 with the compactor 204, the collection drawer 34 is removed and the compactor is mounted within the collection end 12*b* of the housing 12 such that the longitudinal axis of the auger 206 is disposed transverse to the major longitudinal axis of the housing 12 and the open housing 206 is positioned to receive comminuted material from the feeder blower 36. The removable cover end 212 of the compactor housing portion 210 is preferably mounted with a suitable opening in a cover plate (not shown) which covers the entry opening for the drawer 34 so as to enable external removal of the end cover 212 and removal of compacted cylinders of comminuted material.

Having thus described various embodiments of the comminuter apparatus in accordance with the present invention, it will be appreciated that the comminuter apparatus in accordance with the invention is of sturdy construction and is capable of substantially improved comminutation of document materials and the like in a manner to prevent their reconstruction in a legible manner.

While preferred embodiments of the present invention have been illustrated and described, it will be understood that changes and modifications may be made therein without departing from the invention in its broader aspects. Various features of the invention are defined in the following claims.

What is claimed is:

1. A comminuting apparatus comprising, in combination:

a material receiving hopper defining an internal chamber having an access opening and a discharge opening and being configured such that material introduced into said access opening moves toward said discharge opening by gravity;

an annular perforated comminuter plate disposed proximate said discharge opening and defining a cutter chamber communicating with said discharge opening;

a non-perforated plate externally of and generally surrounding said comminuter plate so as to define a discharge chamber therebetween;

a cutter assembly disposed substantially within said cutter chamber and including a primary cutter blade group positioned such that material introduced into said hopper passes by gravity to said primary cutter blade group, said primary cutter blade group being cooperative with said comminuter plate to comminute the material into smaller size particles and cause said particles to pass through said perforated plate into said discharge chamber;

drive means operatively associated with said cutter assembly for effecting rotation of said primary cutter blade group;

waste collection means; and means operatively associated with said discharge chamber and said waste collection means in a manner to effect transfer of comminuted material from said discharge chamber to said waste collection means and induce air flow into said hopper so as to assist in moving material introduced into said hopper toward said cutter assembly and assist in the passage of comminuted material through said perforated plate into said discharge chamber.

2. A comminuter apparatus as defined in claim 1 including a rough-cut blade group mounted with said primary cutter blade group on a common substantially vertically disposed drive shaft, and including drive means operatively associated with said drive shaft in a manner to effect rotation thereof relative to said perforated comminuter plate.

3. A comminuter apparatus as defined in claim 2 wherein said rough-cut blade group includes an upper impact blade having diametrically opposed end portions inclined upwardly into the internal chamber of said hopper, said rough-cut blade group further having a lower impact blade having substantially diametrically opposed end portions inclined downwardly toward said cutter chamber, said upper and lower impact blades being operative to prevent bridging of material across said cutter assembly, said primary cutter blade group being spaced vertically below such rough-cut blade group.

4. A comminuter apparatus as defined in claim 2 wherein said primary cutter blade group includes a plurality of substantially horizontally disposed cutter blades fixed to said drive shaft for rotation therewith, each of said cutter blades having leading cutting edges and having outer marginal terminal ends spaced in close proximity to said annular comminuter plate.

5. A comminuter apparatus as defined in claim 1 wherein said waste collection means includes a waste collection bin, and wherein said air flow inducing means includes a blower assembly operatively interconnected between said discharge chamber and said waste collection bin, said blower assembly including a flow duct interconnected between said discharge chamber and said waste collection bin, and an impellar assembly operative to create air transfer from said discharge chamber to said waste collection bin in a manner to effect flow of comminuted material through said flow duct from said discharge chamber to said waste collection bin.

6. A comminuter apparatus as defined in claim 1 wherein said means for inducing air flow into said hopper includes an air input duct communicating with the internal chamber in said hopper, and valve means operatively associated with said air input duct in a manner to enable selective variation in the flow of air input into said hopper.

7. A comminuter apparatus as defined in claim 6 including a by-pass duct interconnected between said air input duct and said annular discharge chamber, said valve means being operative to effect selective passage of air flow through said by-pass duct to said discharge chamber in a manner to effect air turbulence therein and assist in passage of comminuted material to said waste collection means.

8. A comminuter apparatus as defined in claim 7 including motor drive means operatively associated with said primary cutter blade group so as to effect rotation thereof about a generally vertical axis upon energizing of said drive motor, and including means operatively associated with said drive motor and said valve means so as to effect air flow through said by-pass duct into said discharge chamber in predetermined response to the load on said drive motor.

9. A comminuter apparatus as defined in claim 1 wherein said waste collection means includes a waste collection bin, first duct means interconnecting said discharge chamber to said waste bin to facilitate flow of comminuted material from said discharge chamber to said waste bin, and a return duct interconnected between said waste collection bin and the internal chamber in said hopper to facilitate flow of particulate material from said waste collection bin to said hopper.

10. A comminuter apparatus as defined in claim 1 wherein said drive means includes a drive motor, and including control circuit means operatively associated with said drive motor and including a manually operable primary control switch operative to energize said drive motor during an operating cycle, said control circuit including means operative to delay energizing of said drive motor after initiating an operating cycle through said primary control switch.

11. A comminuter apparatus as defined in claim 1 wherein said perforated comminuter plate has an upper marginal edge affixed to said hopper adjacent said discharge opening thereof such that materials passing through said discharge opening immediately enter said cutter chamber.

12. A comminuter apparatus as defined in claim 11 wherein said non-perforated plate comprises an annular plate concentric with said perforated comminuter plate.

13. A comminuter apparatus as defined in claim 1 including a rough-cut blade group spaced above said primary cutter blade group and including at least one blade disposed substantially within the discharge opening in said hopper.

14. A comminuter apparatus as defined in claim 13 wherein said rough-cut blade group includes at least one blade configured to impell material upwardly within said hopper upon selective engagement with said one blade.

15. A comminuter apparatus as defined in claim 1 including compacting means disposed within said waste collection bid means and adapted to receive comminuted material therein and effect compacting of said comminuted material.

16. A comminuting apparatus comprising, in combination:

a material receiving hopper defining an internal chamber having an access opening and a discharge opening and being configured such that materials introduced into said access opening move toward said discharge opening by gravity;

an annular perforated comminuter plate disposed proximate said discharge opening and defining a cutter chamber communicating with said discharge opening;

a non-perforated plate externally of and generally surrounding said comminuter plate so as to define a discharge chamber therebetween;

a cutter assembly disposed substantially within said cutter chamber and including a rough-cut blade group and a primary cutter blade group, said rough-cut blade group being positioned such that material introduced into said hopper first engages such rough-cut blade group and is cut into smaller size pieces after which said pieces pass by gravity to said primary cutter blade group, said primary cutter blade group being cooperative with said perforated comminuter plate to comminute the pieces into smaller size particles and cause said particles to pass through said perforated plate into said discharge chamber;

and drive means operatively associated with said cutter assembly for effecting rotation of said rough-cut and primary cutter blade groups;

said hopper having a generally conical-shaped configuration defined in part by substantially planar wall surfaces so as to establish a frusto-conical hopper having a noncircular transverse cross-sectional configuration throughout a substantial portion of its height; waste collection means; and means operatively associated with said discharge chamber and said waste collection means in a manner to effect transfer of comminuted material from said discharge chamber to said waste collection means.

17. A comminuter apparatus as defined in claim 16 including a closure member cooperative with said hopper and movable between a closed position covering said access opening in sealed relation thereover, and an open position facilitating access to said hopper to facilitate the introduction of materials therein to be comminuted.

18. A comminuter apparatus as defined in claim 17 wherein said closure member comprises a substantially planar cover member, said hopper having parallel guide tracks thereon generally adjacent said access opening, and guide rollers mounted on said cover member and cooperative with said guide tracks so as to facilitate movement of said cover member in generally its own place between said open and closed positions relative to said access opening.

19. A comminuter apparatus as defined in claim 18 including means operative to selectively lock said cover member in its said closed position.

20. A comminuter apparatus as defined in claim 18 including a high strength woven mesh affixed to the lower surface of said closure member.

21. A comminuter apparatus as defined in claim 17 wherein said closure member comprises a substantially planar cover member slidable in a generally horizontal plane between said closed and open positions, and including a loading chute carried by said cover member and facilitating the selective introduction of relatively small batches of materials into said hopper when said cover member is in its said closed position.

22. A comminuter apparatus as defined in claim 17 including drive means operatively associated with said cutter assembly in a manner to enable selective driven rotation of said rought-cut and primary cutter blade groups, and control circuit means operative to effect energizing of said drive means and thereby effect rotation of said blade groups, said control circuit means including means operative to sense the closed position of said closure member and prevent energizing of said drive means unless said closure member is in its closed position preventing access to said access opening.

23. A comminuting apparatus comprising, in combination:

a substantially rectangular housing adapted for support on a support surface and defining a comminuting end and a waste collection end;

a material receiving hopper disposed within said comminuting end and defining an internal chamber having an access opening and a discharge opening and being configured such that materials introduced into said access opening move toward said discharge opening by gravity;

a closure member supported by said housing for movement between an open position enabling introduction of material into said access opening and a closed position covering said access opening in sealed relation thereover;

an annular perforated comminuter plate disposed proximate said discharge opening and defining a cutter chamber communicating with said discharge opening;

a non-perforated plate externally of and generally surrounding said comminuter plate so as to define a discharge chamber therebetween;

a cutter assembly disposed substantially within said cutter chamber and including a primary cutter blade group positioned such that material introduced into said hopper passes by gravity to said primary cutter blade group, said primary cutter blade group including a plurality of cutter blades having leading cutting edges and outer terminal ends in close proximity to said annular comminuter plate so as to cooperate with said comminuter plate to comminute the material into smaller size particles and cause said particles to pass through said perforated plate into said discharge chamber;

drive means operatively associated with said cutter assembly for effecting rotation of said cutter blades;

waste receiving means disposed within said waste collection end of said housing;

and means operatively associated with said discharge chamber and said waste receiving means in a manner to effect air entrained flow of comminuted material from said discharge chamber to said waste receiving means.

* * * * *